US008796923B2

(12) United States Patent
Matsui et al.

(10) Patent No.: US 8,796,923 B2
(45) Date of Patent: Aug. 5, 2014

(54) PHOTOCATHODE

(75) Inventors: Toshikazu Matsui, Hamamatsu (JP); Yasumasa Hamana, Hamamatsu (JP); Kimitsugu Nakamura, Hamamatsu (JP); Yoshihiro Ishigami, Hamamatsu (JP); Daijiro Oguri, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 178 days.

(21) Appl. No.: 12/996,526

(22) PCT Filed: Nov. 7, 2008

(86) PCT No.: PCT/JP2008/070329

§ 371 (c)(1),
(2), (4) Date: Dec. 6, 2010

(87) PCT Pub. No.: WO2009/150760

PCT Pub. Date: Dec. 17, 2009

(65) Prior Publication Data

US 2011/0089825 A1 Apr. 21, 2011

(30) Foreign Application Priority Data

Jun. 13, 2008 (JP) ..... 2008-155777

(51) Int. Cl.
*H01J 40/06* (2006.01)

(52) U.S. Cl.
CPC ..... *H01J 40/06* (2013.01)
USPC ..... 313/542

(58) Field of Classification Search
CPC ..... H01J 40/06; H01J 1/34
USPC ..... 313/541
See application file for complete search history.

(56) References Cited

U.S. PATENT DOCUMENTS

| | | | | |
|---|---|---|---|---|
| 4,536,679 | A * | 8/1985 | Guittard et al. | 313/541 |
| 2005/0217722 | A1 * | 10/2005 | Komatsu et al. | 136/263 |

FOREIGN PATENT DOCUMENTS

| | | |
|---|---|---|
| CN | 1794399 | 6/2006 |
| JP | 36-6927 | 6/1961 |
| JP | 52-105766 | 9/1977 |
| JP | H05144409 A | 6/1993 |
| JP | 2005-532567 | 10/2005 |
| JP | 2007-242412 | 9/2007 |

OTHER PUBLICATIONS

Herausgegeben Von A. Eckardt et al., "Experimentelle Technik der Physik," Jahrgang, 1965, pp. 1-9 [with partial English translation].

* cited by examiner

*Primary Examiner* — Mary Ellen Bowman
(74) *Attorney, Agent, or Firm* — Drinker Biddle & Reath LLP

(57) ABSTRACT

The present invention aims at providing a photocathode which can improve various characteristics. In a photocathode 10, an intermediate layer 14, an underlayer 16, and a photoelectron emission layer 18 are formed in this order on a substrate 12. The photoelectron emission layer 18 contains Sb and Bi and functions to emit a photoelectron in response to light incident thereon. The photoelectron emission layer 18 contains 32 mol % or less of Bi relative to SbBi. This can dramatically improve the linearity at low temperatures.

23 Claims, 14 Drawing Sheets

(a)

(b)

PHOTOCATHODE

TECHNICAL FIELD

The present invention relates to a photocathode which emits photoelectrons in response to light incident thereon.

BACKGROUND ART

Known as a conventional photocathode is one constructed by vapor-depositing Sb on the inner face of an envelope, vapor-depositing Bi on the vapor-deposited layer, vapor-depositing Sb thereon, so as to form Sb and Bi layers, and causing a vapor of Cs to react therewith (see, for example, Patent Literature 1).

CITATION LIST

Patent Literature

Patent Literature 1: Japanese Patent Application Laid-Open No. 52-105766

SUMMARY OF INVENTION

Technical Problem

The photocathode preferably has a high sensitivity to incident light. For enhancing the sensitivity, it is necessary for the photocathode to raise its effective quantum efficiency which indicates the ratio of the number of photoelectrons emitted to the outside of the photocathode to the number of photons incident on the photocathode. For detecting weak light, the sensitivity is demanded in particular, while it is necessary to lower the dark current. On the other hand, linearity is also demanded in fields requiring measurement with a wide dynamic range such as semiconductor inspection systems. Patent Literature 1 discloses a photocathode using Sb and Bi. However, it has been demanded for the photocathode to improve various characteristics such as the reduction in dark current and increase in linearity, while further raising the quantum efficiency. While the conductivity of the photocathode has conventionally been raised by forming a thin metal film or mesh electrode between an entrance faceplate and the photocathode in the measurement of extremely low temperatures where a particularly high linearity is required, it reduces the transmittance and photoelectric surface area, thereby lowering the effective quantum efficiency.

It is an object of the present invention to provide a photocathode which can improve various characteristics.

Solution to Problem

The photocathode in accordance with the present invention comprises a photoelectron emission layer, adapted to emit a photoelectron to the outside in response to light incident thereon, containing Sb and Bi; wherein the photoelectron emission layer contains 32 mol % or less of Bi relative to the total of Sb and Bi.

This photocathode can dramatically improve the linearity at low temperatures.

Preferably, in the photocathode in accordance with the present invention, the photoelectron emission layer contains 29 mol % or less of Bi relative to the total of Sb and Bi. This can ensure a sensitivity on a par with that of a multi-alkali photocathode, thereby making it possible to secure the quantum efficiency demanded in fields requiring measurement with a wide dynamic range such as semiconductor inspection systems.

Preferably, in the photocathode in accordance with the present invention, the photoelectron emission layer contains 16.7 mol % or less of Bi relative to the total of Sb and Bi. This can yield a sensitivity higher than that of a conventional product in which an Sb layer is disposed on a manganese oxide underlayer and improve the sensitivity in the wavelength range of 500 to 600 nm, i.e., green to red sensitivity, in particular.

Preferably, in the photocathode in accordance with the present invention, the photoelectron emission layer contains 6.9 mol % or less of Bi relative to the total of Sb and Bi. This can yield a high sensitivity with a quantum efficiency of 35% or higher.

Preferably, in the photocathode in accordance with the present invention, the photoelectron emission layer contains 0.4 mol % or more of Bi relative to the total of Sb and Bi. This can lower the dark current reliably.

Preferably, in the photocathode in accordance with the present invention, the photoelectron emission layer contains 8.8 mol % or more of Bi relative to the total of Sb and Bi. This can stably yield a linearity on a par with the upper limit for the linearity of the multi-alkali photocathode.

Preferably, the photocathode in accordance with the present invention has a linearity at −100° C. higher than 0.1 times that at 25° C. Preferably, it exhibits a quantum efficiency of 20% or higher at a peak in the wavelength range of 320 to 440 nm and a quantum efficiency of 35% or higher at a peak in the wavelength range of 300 to 430 nm.

Preferably, the photocathode in accordance with the present invention further comprises an intermediate layer formed from $HfO_2$ on the light entrance side of the photoelectron emission layer.

Preferably, the photocathode in accordance with the present invention further comprises an underlayer formed from MgO on the light entrance side of the photoelectron emission layer.

Preferably, in the photocathode in accordance with the present invention, the photoelectron emission layer is formed by causing a metallic potassium vapor and a metallic cesium vapor (a metallic rubidium vapor) to react with a thin alloy film of SbBi.

Advantageous Effects of the Invention

The present invention can improve various characteristics.

REFERENCE SIGNS LIST

10 . . . photocathode; 12 . . . substrate; 14 . . . intermediate layer; 16 . . . underlayer; 18 . . . photoelectron emission layer

DESCRIPTION OF EMBODIMENTS

In the following, the photocathode in accordance with an embodiment will be explained in detail with reference to the drawings.

Figure 1:
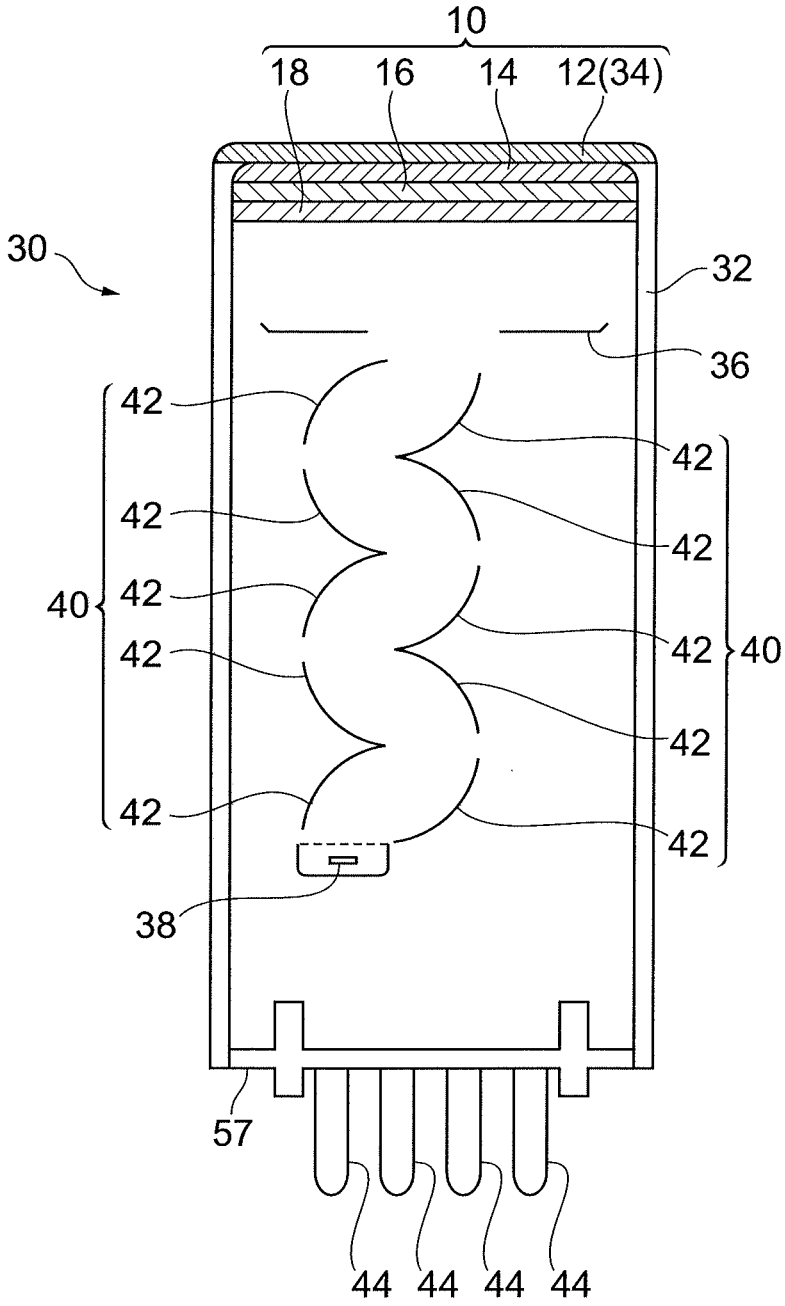
[FIG. 1] is a view illustrating a cross-sectional structure of a photomultiplier employing the photocathode in accordance with an embodiment as a transmission type.

FIG. 1 is a view illustrating a cross-sectional structure of a photomultiplier employing the photocathode (photoelectric surface) in accordance with this embodiment as a transmission type. This photomultiplier 30 comprises an entrance window 34 for transmitting therethrough light incident thereon and an envelope 32 formed by sealing one opening end of a cylindrical tube with the entrance window 34. Provided within the envelope 32 are a photocathode 10 for emitting photoelectrons, a focusing electrode 36 for guiding the emitted photoelectrons to a multiplication unit 40, the multiplication unit 40 for multiplying electrons, and an anode 38 for collecting the multiplied electrons. The photomultiplier 30 is constructed such that a substrate 12 of the photocathode 10 functions as the entrance window 34.

The multiplication unit 40 disposed between the focusing electrode 36 and the anode 38 is constituted by a plurality of dynodes 42. The focusing electrode 36, dynodes 42, photocathode 10, and anode 38 are electrically connected to stem pins 44 which are provided so as to penetrate through a stem plate 57 disposed at an end portion of the envelope 32 on the side opposite from the photocathode 10.

Figure 2:
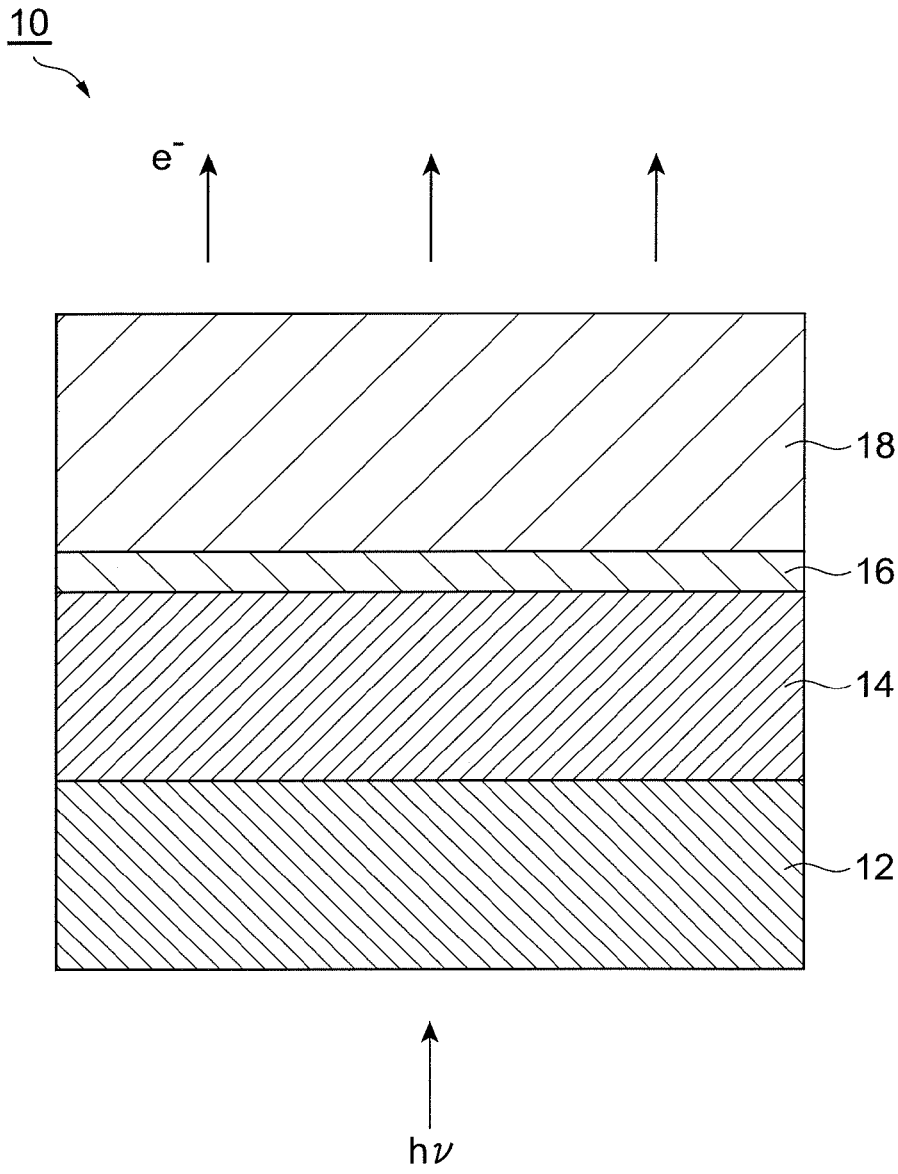
[FIG. 2] is a sectional view partly enlarging the structure of the photocathode in accordance with the embodiment.

FIG. 2 is a sectional view partly enlarging the structure of the photocathode in accordance with the embodiment. In this photocathode 10, as illustrated in FIG. 2, an intermediate layer 14, an underlayer 16, and a photoelectron emission layer 18 are formed in this order on the substrate 12. The photocathode 10 is schematically illustrated as a transmission type in which light hv is incident thereon from the substrate 12 side, while photoelectrons $e^-$ are emitted from the photoelectron emission layer 18 side.

The substrate 12 is constituted by one on which the intermediate layer 14 made of hafnium oxide ($HfO_2$) can be formed. Preferably, the substrate 12 transmits therethrough light having a wavelength of 177 to 1000 nm. Examples of such a substrate include those made of high-purity synthetic silica glass, borosilicate glass (e.g., Kovar glass), and Pyrex glass (registered trademark). Preferably, the substrate 12 has a thickness of 1 to 5 mm, by which optimal transmittance and mechanical strength can be maintained.

Preferably, the intermediate layer 14 is formed from $HfO_2$. $HfO_2$ exhibits a high transmittance for light having a wavelength of 300 to 1000 nm. $HfO_2$ allows Sb formed thereon to have a finer island structure. This intermediate layer 14 is formed by vapor-depositing $HfO_2$ on the substrate 12 corresponding to the entrance window 34 for the envelope 32 made of a washed glass bulb. For example, the vapor deposition is carried out by an EB vapor deposition method using an EB (electron beam) vapor deposition system. In particular, the intermediate layer 14 and the underlayer 16 constituted by a combination of $HfO_2$—MgO are effective in preventing light from being reflected thereby, while allowing them to serve as a buffer layer between the photoelectron emission layer 18 and the substrate 12.

Preferably, the underlayer 16 is made of a material such as manganese oxide, MgO, or $TiO_2$ which transmits therethrough light having a wavelength of 117 to 1000 nm. In particular, the underlayer 16 formed from MgO can attain a high sensitivity with a quantum efficiency of 20% or higher, or 35% or higher. Providing the MgO underlayer is effective in preventing light from being reflected thereby, while allowing it to serve as a buffer layer between the photoelectron emission layer 18 and the substrate 12. The underlayer 16 is formed by vapor-depositing a predetermined oxide.

The photoelectron emission layer 18 is formed by causing a metallic potassium vapor and a metallic cesium vapor, or a metallic rubidium vapor and a metallic cesium vapor to react with a thin alloy film of SbBi. The photoelectron emission layer 18 is formed as a porous layer constituted by Sb—Bi—K—Cs or Sb—Bi—Rb—Cs. The photoelectron emission layer 18 functions as a photoelectron emission layer of the photocathode 10. The thin alloy film of SbBi is vapor-deposited on the underlayer 16 by a sputtering vapor deposition method, an EB vapor deposition method, or the like. The thickness of the photoelectron emission layer 18 falls within the range of 150 to 1000 Å.

As a result of diligent studies, the inventors have found that, when Sb in the photoelectron emission layer 18 contains Bi by a predetermined amount or greater, carriers caused by lattice defects increase, thereby enhancing the conductivity of the photocathode. Hence, the photocathode 10 has been found to be able to improve its linearity by containing Bi. While high-sensitivity photocathodes have been problematic in that the dark current becomes greater therein, Sb containing Bi has been found to be able to reduce the dark current.

Figure 3:
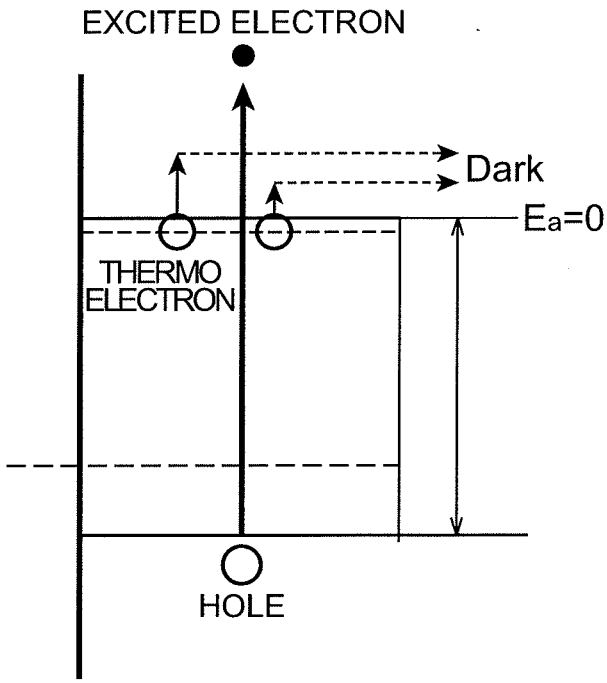
[FIG. 3] is a conceptual diagram for explaining the idea that the dark current can be lowered when Bi is contained in Sb.
Figure 3:
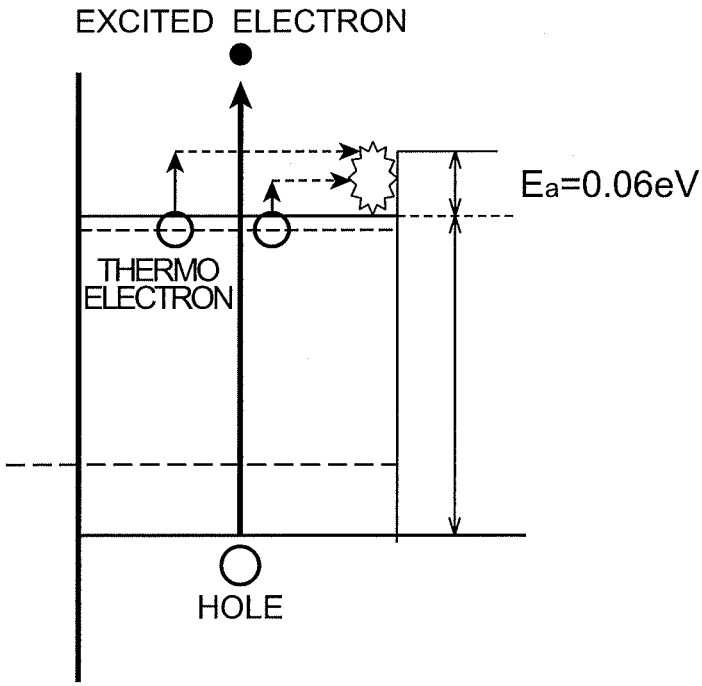

FIG. 3 is a conceptual diagram for explaining the idea that the dark current can be lowered when Bi is contained in Sb, in which (a) is a conceptual diagram of a photocathode containing no Bi, while (b) is a conceptual diagram of a photodiode containing Bi. In the photocathode containing no Bi, as illustrated in FIG. 3(*a*), the thermoelectronic energy (0.038 eV at room temperature) is excited at an impurity level near a conduction band, so as to be emitted as thermoelectrons, whereby a dark current occurs. As illustrated in FIG. 3(b), by making Sb contain Bi, the photocathode 10 in accordance with this embodiment can generate a surface barrier (Ea value=0.06 eV at a Bi content of 2.1 mol %), so as to block the thermoelectrons with the surface barrier, thereby inhibiting the dark current from occurring. As the Bi content is greater, on the other hand, the Ea value of the surface barrier further increases, thereby lowering the quantum efficiency. However, the inventors have found a Bi content which can fully secure sensitivities required according to fields of application.

When the photocathode 10 is used in a foreign object inspection system for a semiconductor, scattered light becomes weaker and stronger when a laser beam irradiates smaller and greater foreign objects, respectively. Therefore, the photocathode 10 is required to have such a sensitivity as to detect weak scattered light and such a wide dynamic range as to respond to both of the weak scattered light and strong scattered light. Thus, in fields requiring measurement with a wide dynamic range as in a semiconductor inspection system, the Bi content relative to SbBi, i.e., the ratio of the molar quantity of Bi to the total molar quantity of Sb and Bi, in the photoelectron emission layer 18 is preferably at least 8.8 mol % but not exceeding 32 mol %, more preferably at least 8.8 mol % but not exceeding 29 mol %, in order to secure the sensitivity and linearity required in this field. This ratio is preferably at least 16.7 mol % but not exceeding 32 mol % in order to secure the linearity of the photocathode 10 at a low temperature.

When the photocathode 10 is employed in a field such as a high-energy physical experiment requiring a sensitivity in particular and making it necessary to minimize the dark current, the Bi content relative to Sb in the photoelectron emission layer 18 is preferably 16.7 mol % or less, more preferably at least 0.4 mol % but not exceeding 16.7 mol %, in order to secure the required sensitivity while fully lowering the dark current. The ratio is more preferably at least 0.4 mol % but not exceeding 6.9 mol %, since a particularly high sensitivity can be obtained thereby.

Operations of the photocathode 10 and photomultiplier 30 will now be explained. In the photomultiplier 30, as illustrated in FIGS. 1 and 2, the incident light hv transmitted through the entrance window 34 enters into the photocathode 10. The light hv enters from the substrate 12 side and passes through the substrate 12, intermediate layer 14, and underlayer 16, so as to reach the photoelectron emission layer 18. The photoelectron emission layer 18 functions as an active layer for emitting photoelectrons, so as to absorb photons and generate photoelectrons $e^-$. The photoelectrons $e^-$ generated in the photoelectron emission layer 18 are emitted from the surface thereof. Thus emitted photoelectrons $e^-$ are multiplied by the multiplication unit 40 and collected by the anode 38.

Samples of the photocathode in accordance with examples and comparative examples will now be explained. Each of the samples of the photocathode in accordance with the examples has an intermediate layer 14 made of hafnium oxide ($HfO_2$) formed on a borosilicate glass substrate 12 and an underlayer 16 made of MgO formed thereon. An SbBi alloy film containing Bi by a predetermined content is formed on the underlayer 16 of this sample and then exposed to a metallic potassium vapor and a metallic cesium vapor until the photocathode sensitivity is seen to attain the maximum value, whereby the photoelectron emission layer 18 is formed. The SbBi layer of the photoelectron emission layer 18 has a thickness of 30 to 80 Å (150 to 400 Å in terms of the photoelectron emission layer).

Employed as the samples of the photocathode in accordance with the comparative examples are samples of conventional bi-alkali photocathode products (Comparative Examples A1 and A2) constructed by forming a manganese oxide underlayer on a borosilicate glass substrate, forming an Sb film thereon, and causing a metallic potassium vapor and a metallic cesium vapor to react therewith, so as to yield a photoelectron emission layer; and a sample of a multi-alkali photocathode (Comparative Example B) constructed by causing a metallic sodium vapor, a metallic potassium vapor, and a metallic cesium vapor to react with an Sb film on a UV-transparent glass substrate, so as to form a photoelectron emission layer. Also employed as samples of the photocathode in accordance with the comparative examples are photocathode samples (Comparative Examples C1, C2, D, and E) having the same structure as with samples of the photocathode in accordance with the examples except that no Bi is contained in their photoelectron emission surfaces at all.

FIGS. 4 to 7 illustrate spectral sensitivity characteristics of photocathode samples having Bi contents of 0.4 to 32 mol % in accordance with the examples, a photocathode sample (Comparative Example C2) in accordance with a comparative sample having the same structure as with the examples except that the Bi content is 0 mol %, a conventional bi-alkali photocathode product sample (Comparative Example A1) using manganese oxide as an underlayer, and a multi-alkali photocathode sample (Comparative Example B). FIGS. 4 to 7 are graphs illustrating the quantum efficiency at each wavelength of respective sets of photocathode samples with Bi contents of 0 mol %, 0.4 mol %, 0.9 mol %, and 1.8 mol %; 2.0 mol %, 2.1 mol %, 6.9 mol %, and 8.8 mol %; 10.5 mol %, 11.4 mol %, 11.7 mol %, and 12 mol %; and 13 mol %, 16.7 mol %, 29 mol %, and 32 mol %. In each of the graphs of FIGS. 4 to 7, the abscissa and ordinate indicate the wavelength (nm) and quantum efficiency (%), respectively. Each of FIGS. 4 to 7 also illustrates the spectral sensitivity characteristics of the conventional bi-alkali photocathode product sample (Comparative Example A1) using manganese oxide as the underlayer and the multi-alkali photocathode sample (Comparative Example B).

Figure 4:
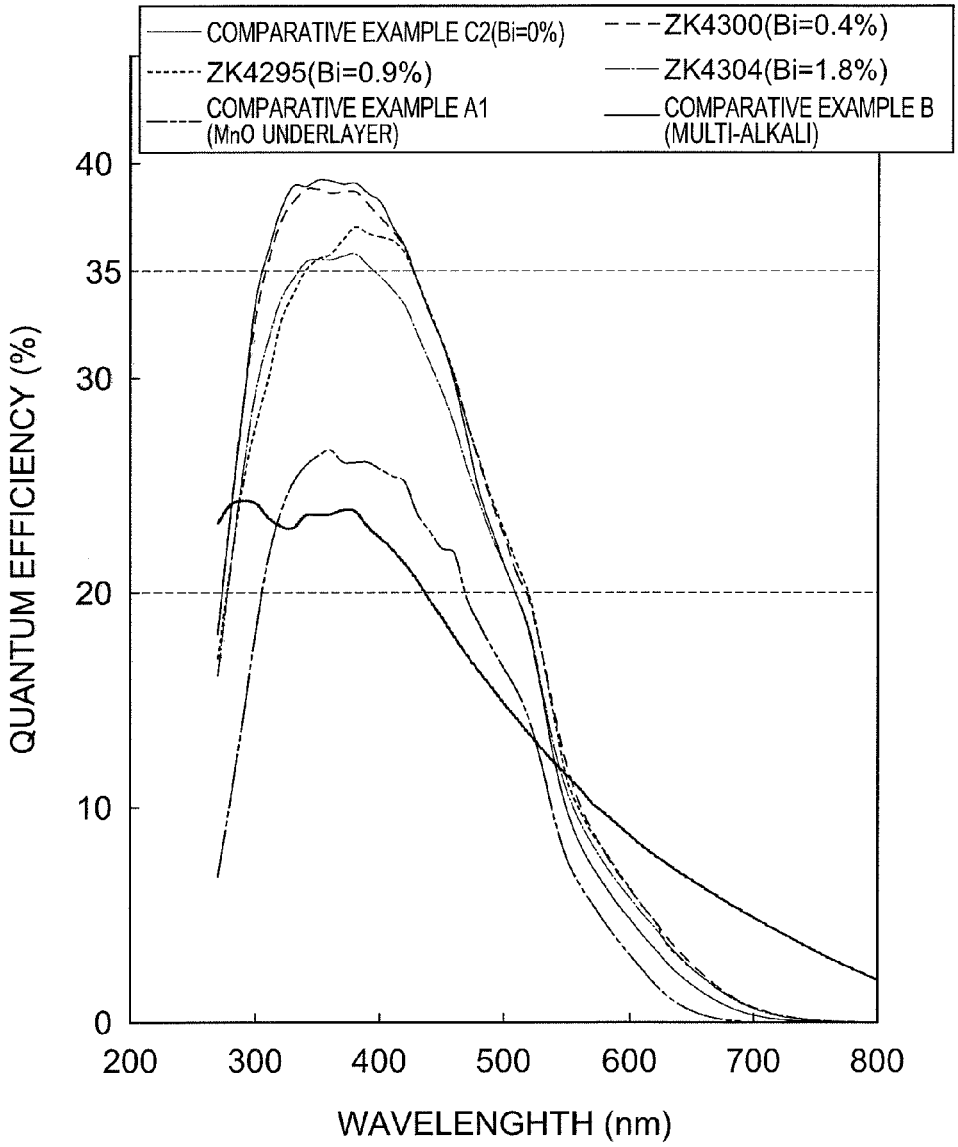
[FIG. 4] is a graph illustrating spectral sensitivity characteristics of examples and comparative examples.
Figure 5:
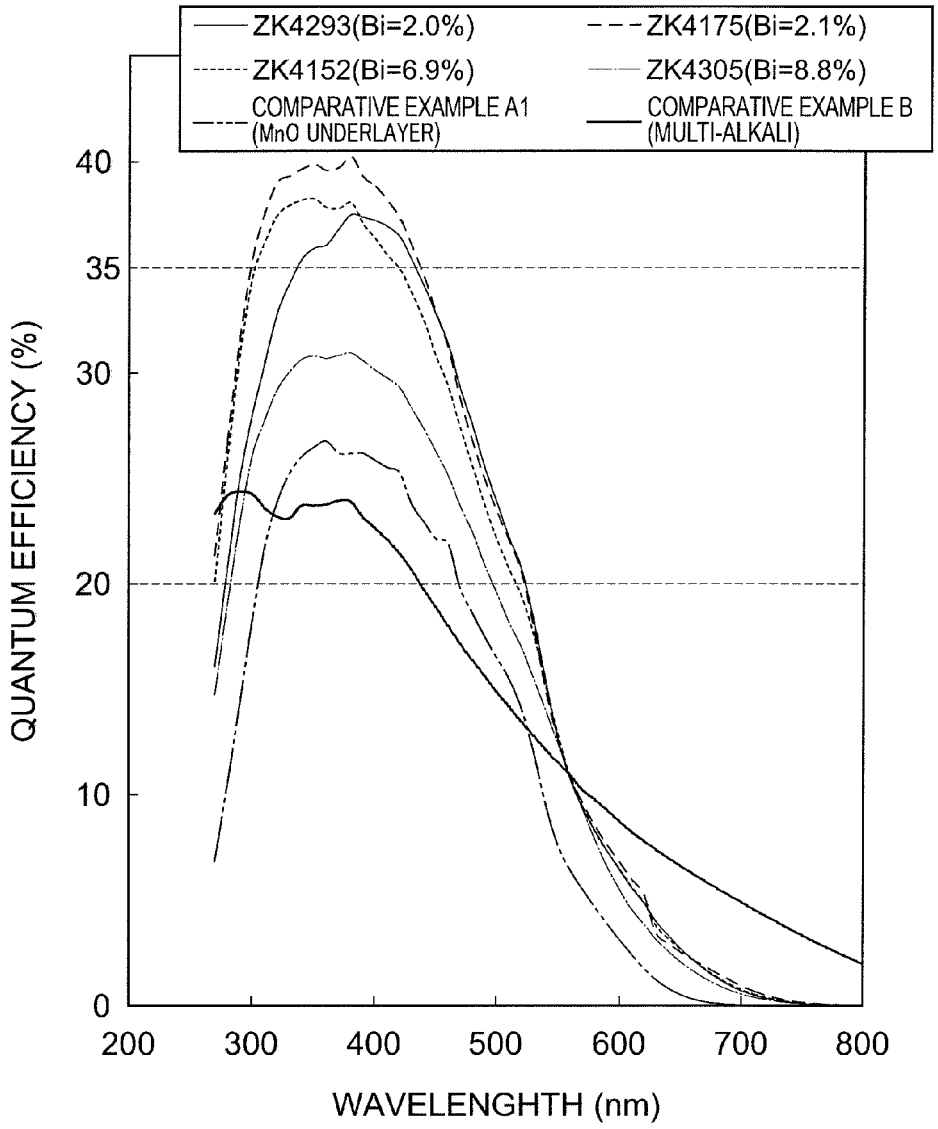
[FIG. 5] is a graph illustrating spectral sensitivity characteristics of examples and the comparative examples.

As can be seen from FIGS. 4 and 5, each of the sample (ZK4300) with the Bi content of 0.4 mol %, the sample (ZK4295) with the Bi content of 0.9 mol %, the sample (ZK4304) with the Bi content of 1.8 mol %, the sample (ZK4293) with the Bi content of 2.0 mol %, the sample (ZK4175) with the Bi content of 2.1 mol %, and the sample (ZK4152) with the Bi content of 6.9 mol % exhibits a quantum efficiency of 35% or higher at a peak within the wavelength range of 300 to 430 nm. Therefore, it is understood that a quantum efficiency of 35% or higher, which is believed to be a sufficient sensitivity in fields requiring the sensitivity in particular, can be secured when the photoelectron emission layer 18 contains 6.9 mol % or less of Bi relative to the total of Sb and Bi. The sample (Comparative Example C2) with the Bi content of 0 mol % is also seen to be able to secure a high sensitivity, but increases the dark current as will be explained later and fails to attain the linearity sufficiently.

Figure 6:
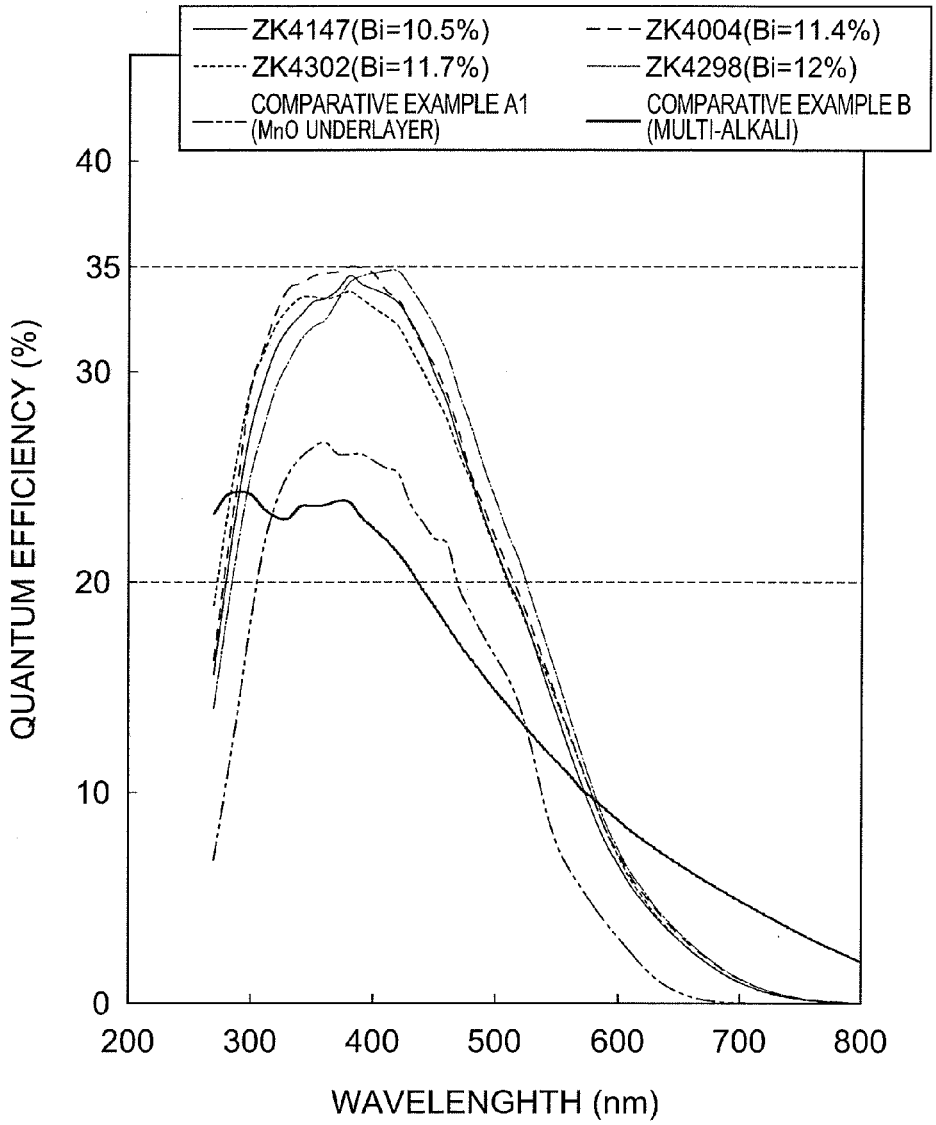
[FIG. 6] is a graph illustrating spectral sensitivity characteristics of examples and the comparative examples.
Figure 7:
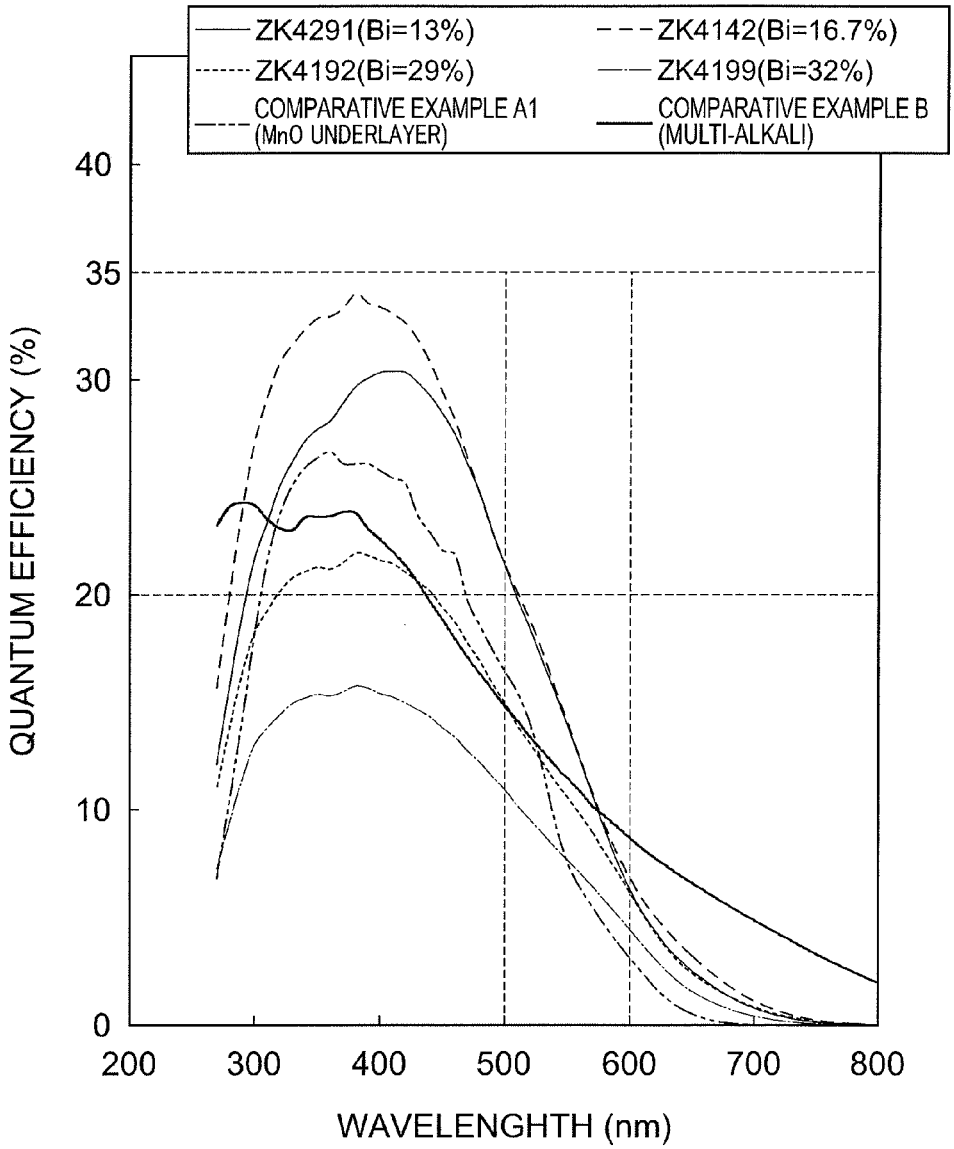
[FIG. 7] is a graph illustrating spectral sensitivity characteristics of examples and the comparative examples.

As can be seen from FIGS. 5 to 7, each of the sample (ZK4305) with the Bi content of 8.8 mol %, the sample (ZK4147) with the Bi content of 10.5 mol %, the sample (ZK4004) with the Bi content of 11.4 mol %, the sample (ZK4302) with the Bi content of 11.7 mol %, the sample (ZK4298) with the Bi content of 12 mol %, the sample (ZK4291) with the Bi content of 13 mol %, and the sample (ZK4142) with the Bi content of 16.7 mol % exhibits a quantum efficiency of 20% or higher at a peak within the wavelength range of 300 to 500 nm and a quantum efficiency higher than that of the conventional bi-alkali photocathode product sample (Comparative Example A1) employing manganese oxide as the underlayer at all the wavelengths. Therefore, it is understood that a quantum efficiency higher than that of the conventional bi-alkali photocathode can be secured when the photoelectron emission layer contains 16.7 mol % or less of Bi relative to SbBi therein. In particular, a quantum efficiency higher than that of the conventional product sample is exhibited within the wavelength range of 500 to 600 nm when the Bi content is 16.7 mol % or less. Hence, it is understood that the sensitivity within the wavelength range of 500 to 600 nm, i.e., green to red sensitivity, can be improved over the conventional bi-alkali photocathode when the photoelectron emission layer contains 16.7 mol % or less of Bi relative to SbBi.

As can be seen from FIG. 7, the sample (ZK4192) with the Bi content of 29 mol % exhibits a quantum efficiency of 20% or higher at a peak within the wavelength range of 320 to 440 nm. Therefore, it is understood that a quantum efficiency of 20% or higher, which is believed to be a sufficient sensitivity in fields such as semiconductor inspection systems where the quantity of incident light is large, can be attained when the photoelectron emission layer contains 29 mol % or less of Bi relative to SbBi therein. This sample also exhibits a quantum efficiency greater than or on a par with that of the multi-alkali photocathode sample (Comparative Example B) within the wavelength range of 450 to 500 nm.

Table 1 lists results of experiments comparing the cathode sensitivity, anode sensitivity, dark current, cathode blue sensitivity index, and dark counts among the Bi contents of photocathodes. Table 1 represents the measurement results of samples with the Bi contents of 0.4 to 16.7 mol % as the photocathodes in accordance with the examples and the measurement results of the conventional bi-alkali photocathode product (Comparative Example A1) employing manganese oxide as the underlayer and the photocathode samples (Comparative Examples C1, D, and E) whose Bi content is 0 mol % as the photocathodes in accordance with the comparative examples. Each of the samples with the Bi contents of 0.4 to 16.7 mol % and the photocathode samples (Comparative Examples C1, D, and E) with the Bi content of 0 mol % has the intermediate layer 14 made of hafnium oxide ($HfO_2$) formed on the substrate 12 and the underlayer 16 made of MgO formed thereon.

TABLE 1

| Sample | Bi compounding ratio | Cathode sensitivity μA/Lm | Anode sensitivity 1000 V A/Lm | Dark current 1000 V | Dark current 1250 V nA | Dark current 1500 V | Cathode blue sensitivity index A/Lm | Dark Counts (−1000 V) ⅓ Peak |
|---|---|---|---|---|---|---|---|---|
| Comparative Example A1 | 0.0 | 96 | 269 | 1.10 | — | 100.0 | 10.1 | 681 |
| Comparative Example C1 | 0.0 | 159 | 270 | 5.00 | — | 120.0 | 15.4 | 4984 |
| Comparative Example D | 0.0 | 146.0 | 18.1 | 6.2 | — | — | 15.2 | 6917 |
| Comparative Example E | 0.0 | 139.0 | 169.0 | 2.6 | — | — | 14.7 | 3647 |
| ZK4299 | 0.4 | 144.0 | 171.0 | 4.7 | 17.0 | 50.0 | 13.5 | 835 |
| ZK4300 | 0.4 | 147.0 | 177.0 | 7.2 | 100.0 | 5000.0 | 13.7 | 1622 |
| ZK4295 | 0.9 | 145.0 | 154.0 | 4.6 | 18.0 | 55.0 | 13.1 | 869 |
| ZK4296 | 0.9 | 113.0 | 209.0 | 1.9 | 7.1 | 22.0 | 11.1 | 1187 |
| ZK4303 | 1.8 | 142.0 | 165.0 | 6.4 | 25.0 | 74.0 | 12.1 | 1370 |
| ZK4304 | 1.8 | 143.0 | 198.0 | 9.8 | 39.0 | 120.0 | 12.9 | 1254 |
| ZK4293 | 2.0 | 156.0 | 236.0 | 1.2 | 4.5 | 14.0 | 13.8 | 1198 |
| ZK4294 | 2.0 | 152.0 | 174.0 | 1.7 | 5.4 | 18.0 | 14.2 | 1070 |
| ZK4175 | 2.1 | 168 | 398 | 1.0 | 4.0 | 38 | 15.2 | 1549 |
| ZK4152 | 6.9 | 164 | 450 | 1.5 | 5.3 | 17 | 14.6 | 2124 |
| ZK4147 | 10.5 | 159 | 350 | 0.7 | 2.9 | 9 | 12.9 | 1917 |
| ZK4291 | 13.0 | 140.0 | 225.0 | 3.9 | 15.0 | 46.0 | 11.1 | 599 |
| ZK4142 | 16.7 | 165 | 270 | 0.98 | 2.7 | 7.5 | 12.8 | 1685 |

The cathode blue sensitivity index in Table 1 is a cathode current (A/lm-b) obtained when a filter having half of thickness of a blue filter CS-5-58 (manufactured by Corning Glass Works) is interposed in front of the photomultiplier 30 at the time of measuring the luminous sensitivity.

Figure 8:
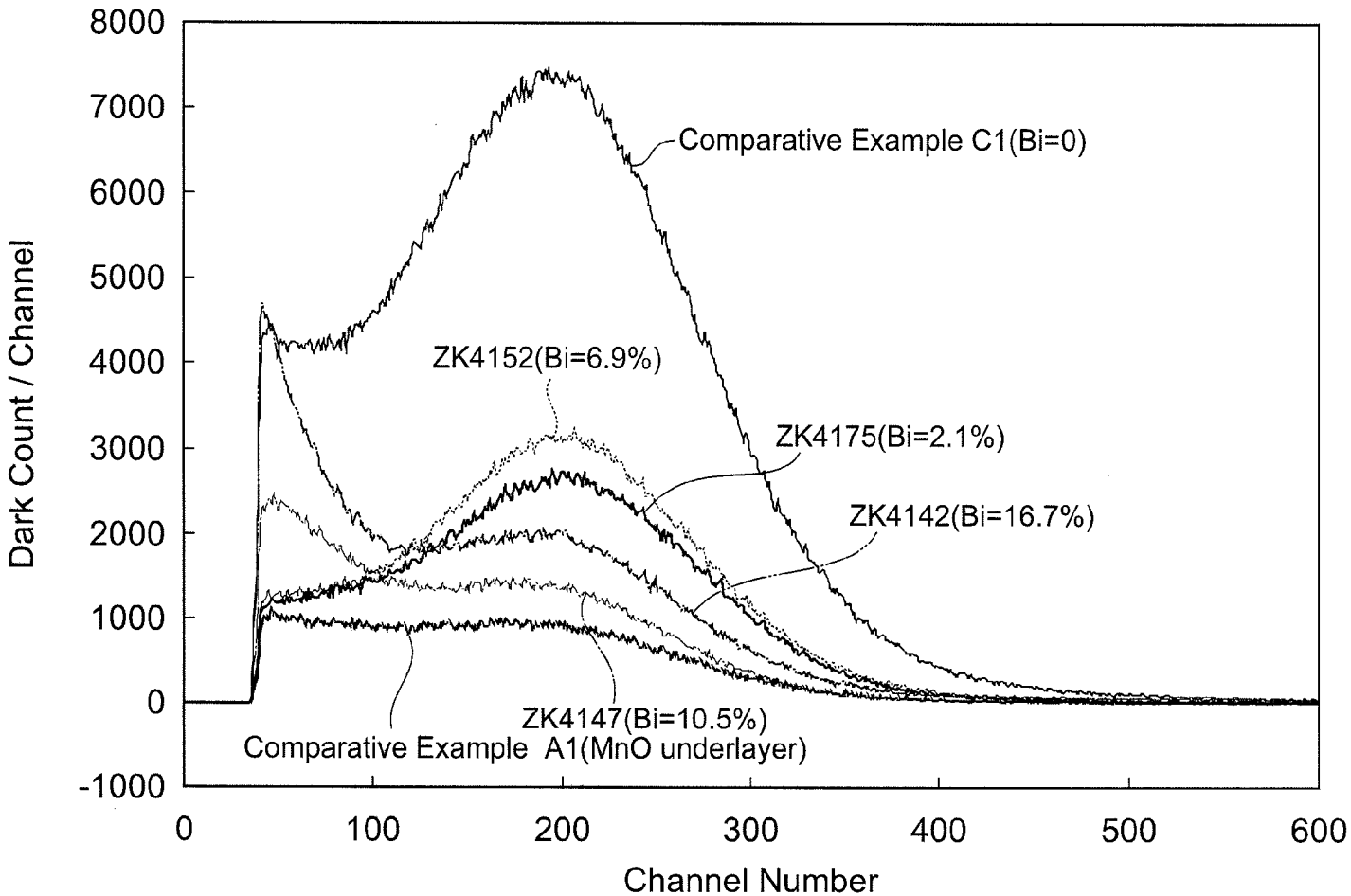
[FIG. 8] is a chart illustrating the number of counts of photoelectrons emitted from the photoelectron emission layer at each intensity in a dark state.

The dark counts in Table 1 are values, measured in a room temperature environment at 25° C., for relatively comparing the numbers of photoelectrons emitted from the photoelectron emission layer 18 in a dark state where light is blocked from entering the photocathode 10. The dark counts are specifically calculated according to the results of FIG. 8 obtained by a measuring device which counts the photoelectrons. FIG. 8 is a chart illustrating the number of counts of photoelectrons emitted from the photoelectron emission layer at each intensity in the dark state for the photocathode samples having the Bi contents of 0 mol % (Comparative Example C1), 2.1 mol %, 6.9 mol %, 10.5 mol %, and 16.7 mol % and the conventional product sample (Comparative Example A1) employing manganese oxide as the underlayer. The abscissa and ordinate in FIG. 8 represent the channels of the measuring device and the number of counts of the photoelectrons detected at each channel, respectively. The dark counts in Table 1 indicate the integrated value of numbers of counts at a channel whose number of counts is ⅓ or greater than that of a channel where the number of counts of photoelectrons indicated in FIG. 8 is at its peak. (Specifically, a peak occurs at 200 ch, whose ⅓ is 200/3=67 ch.) Thus comparing the integrated values of numbers of counts at ⅓ or more of the peak channel can eliminate influences such as fluctuations within circuits of the system.

As can be seen from Table 1, the conventional product sample (Comparative Example A1) employing manganese oxide as the underlayer fails to yield a sufficient cathode blue sensitivity index, while exhibiting low values for the dark current and dark count. The photocathode samples containing Bi in accordance with the examples can yield a cathode blue sensitivity higher than that of Comparative Example A1, while attaining low values for the dark current and dark count.

Figure 9:
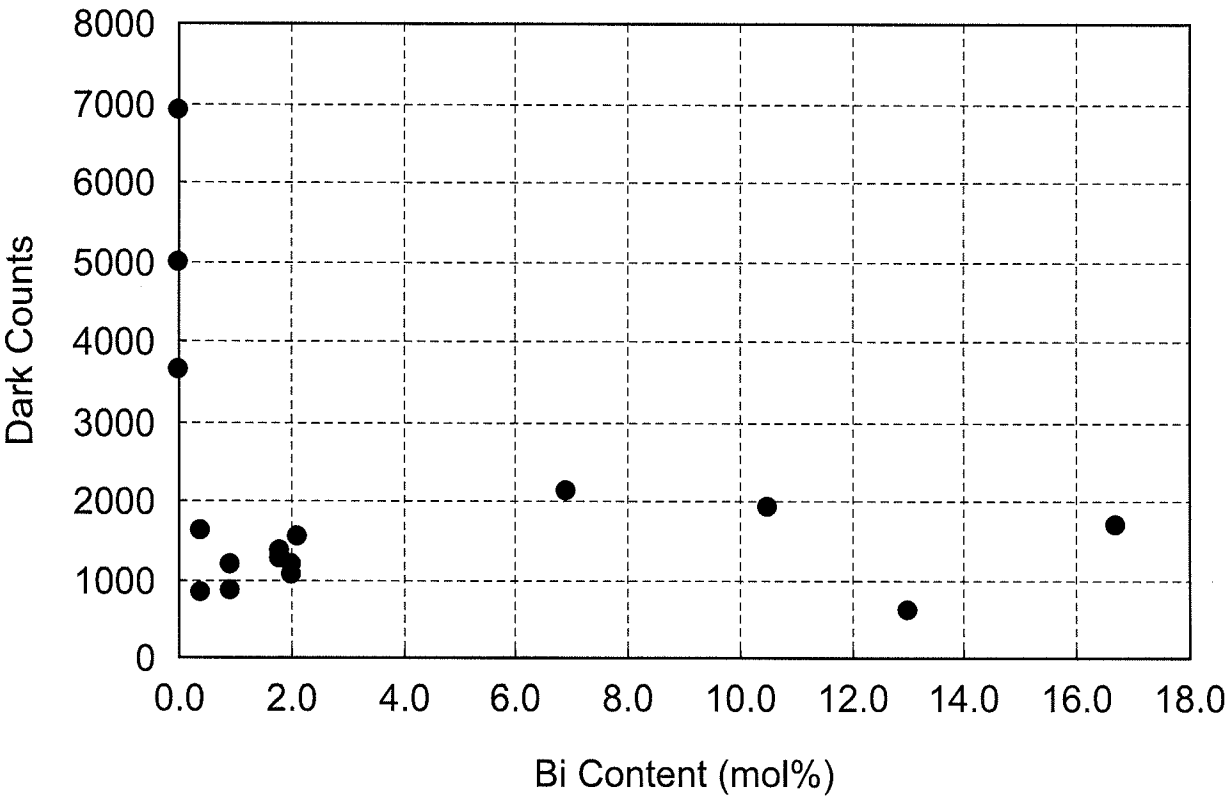
[FIG. 9] is a graph plotting dark count values in examples and comparative examples.

FIG. 9 illustrates the relationship between the dark count value and Bi content listed in Table 1. FIG. 9 is a graph plotting dark count values in the photocathode samples having the Bi contents of 0.4 to 16.7 mol % and those (Comparative Examples C1, D, and E) having the Bi content of 0 mol % and employing $HfO_2$ as the intermediate layer. The abscissa and ordinate in FIG. 9 represent the Bi content (mol %) and the dark count value, respectively.

As can be seen from FIG. 9, each of the photocathode samples having the Bi content of 0.4 mol % or greater exhibits a dark counts value which is reduced by ½ or more from that of any of the photocathode samples (Comparative Examples C1, D, and E) having the Bi content of 0 mol %. The reduction in dark count is also observed at the Bi content of 13 mol % between 10.5 mol % or more and 16.7 mol % or less.

Figure 10:
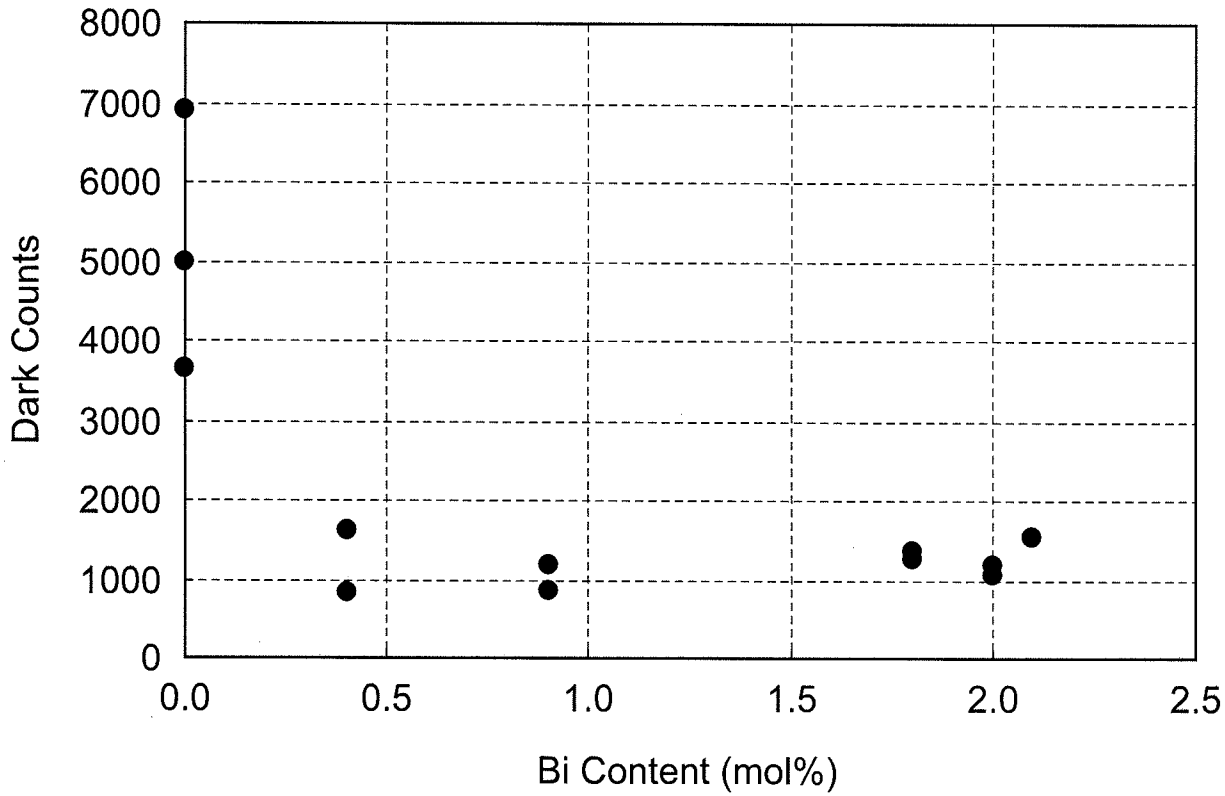
[FIG. 10] is a graph plotting dark count values in the examples and comparative examples.

FIG. 10 illustrates the relationship between the dark count value and Bi content in a low Bi content region in FIG. 9. FIG. 10 is a graph plotting dark count values in the photocathode samples having the Bi contents of 0.4 to 2.1 mol % and those (Comparative Examples C1, D, and E) having the Bi content of 0 mol % and employing $HfO_2$ as the intermediate layer. The abscissa and ordinate in FIG. 10 represent the Bi content (mol %) and the dark count value, respectively.

As can be seen from FIG. 10, the photocathode sample having the Bi content of 0.4 mol % exhibits a dark count which is remarkably lower than that of any of the photocathode samples (Comparative Examples C1, D, and E) having the Bi content of 0 mol %. It is therefore understood that even a minute amount of Bi, i.e., a Bi content of more than 0 mol %, is effective in reducing the dark count value. The foregoing makes it clear that Sb containing Bi can reduce the dark count value, while yielding a cathode blue sensitivity index higher than that of the conventional product samples employing manganese oxide as the underlayer (see Table 1).

Figure 11:
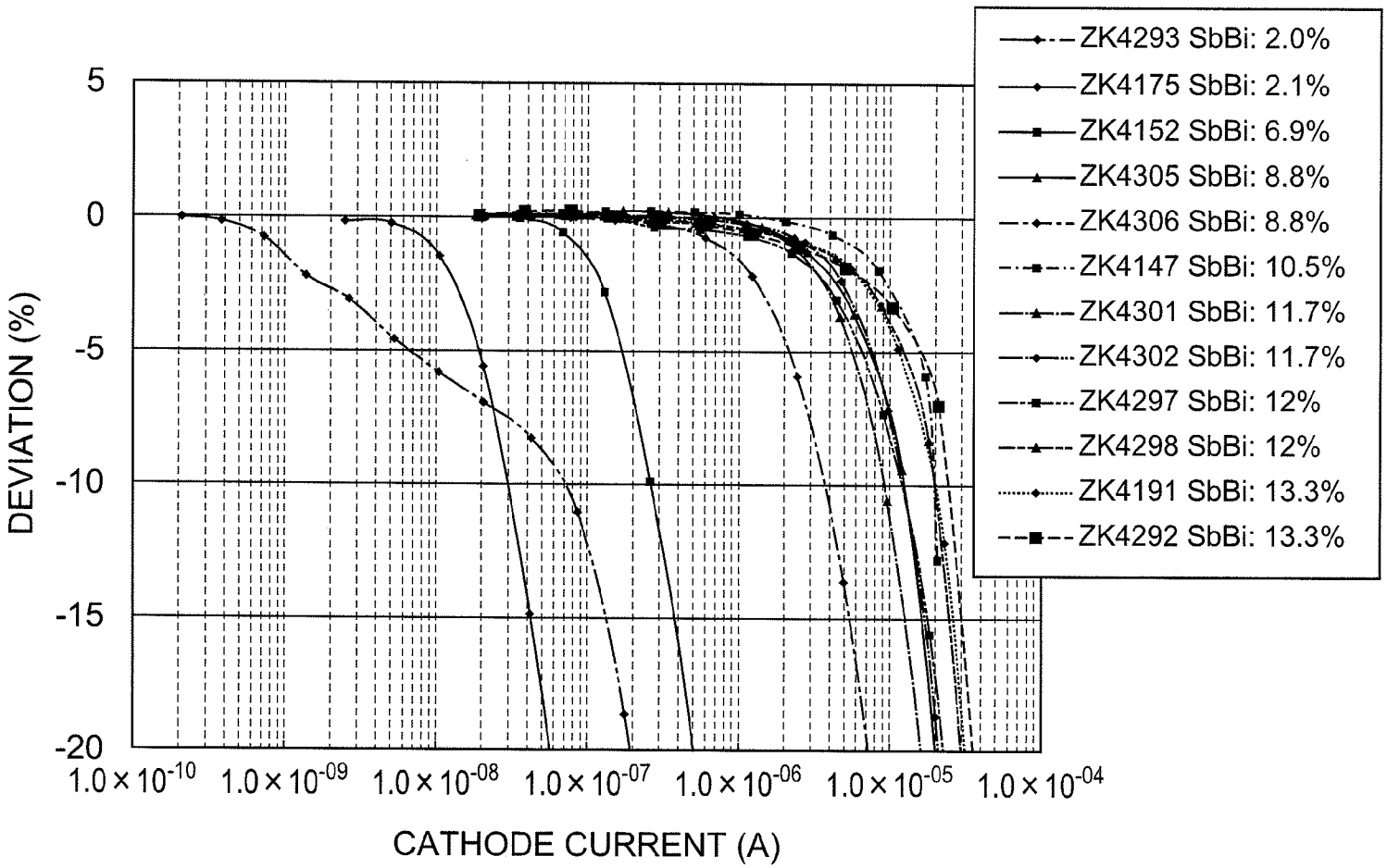
[FIG. 11] is a graph illustrating the linearity of examples.
Figure 12:
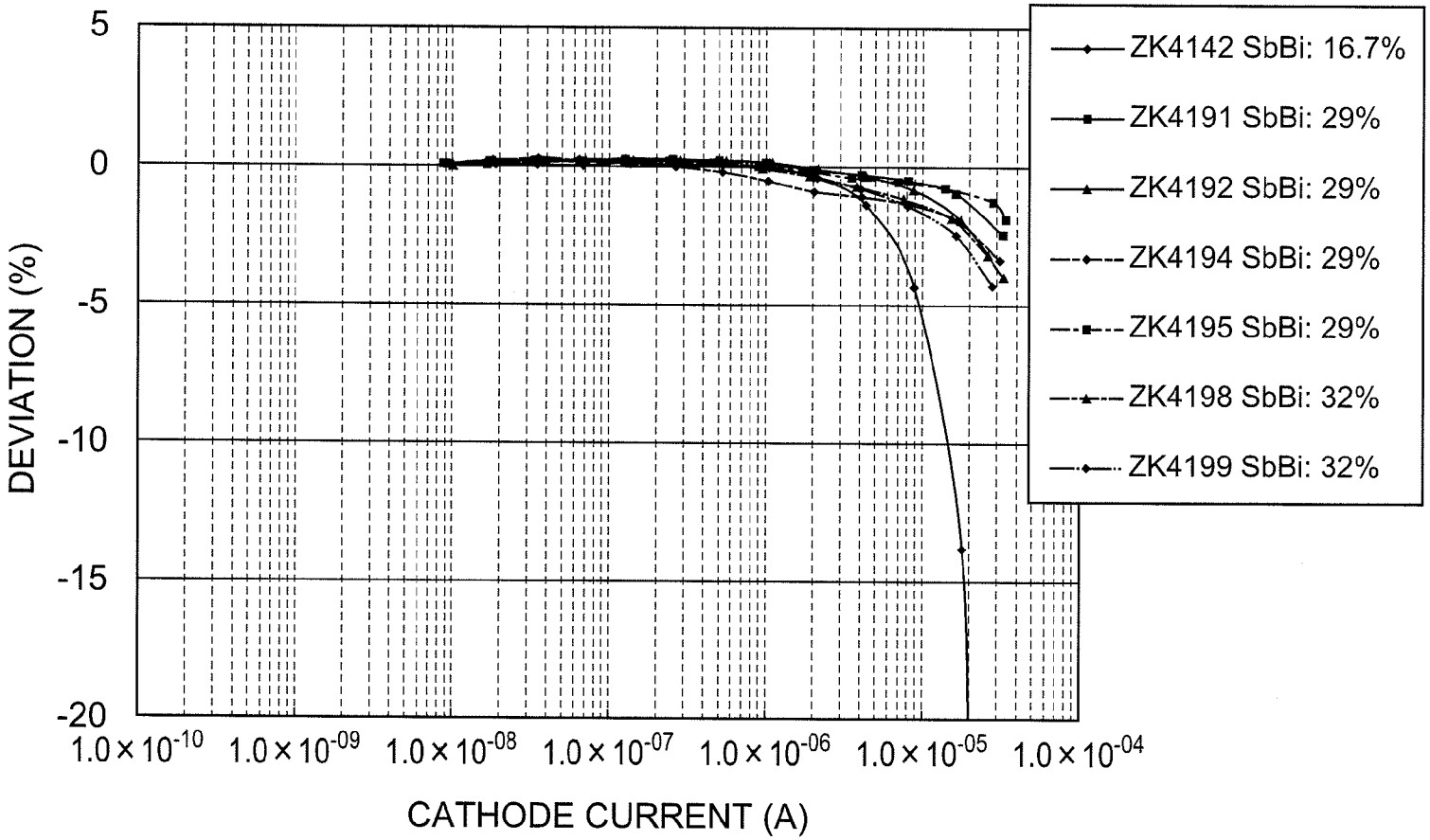
[FIG. 12] is a graph illustrating the linearity of examples.
Figure 13:
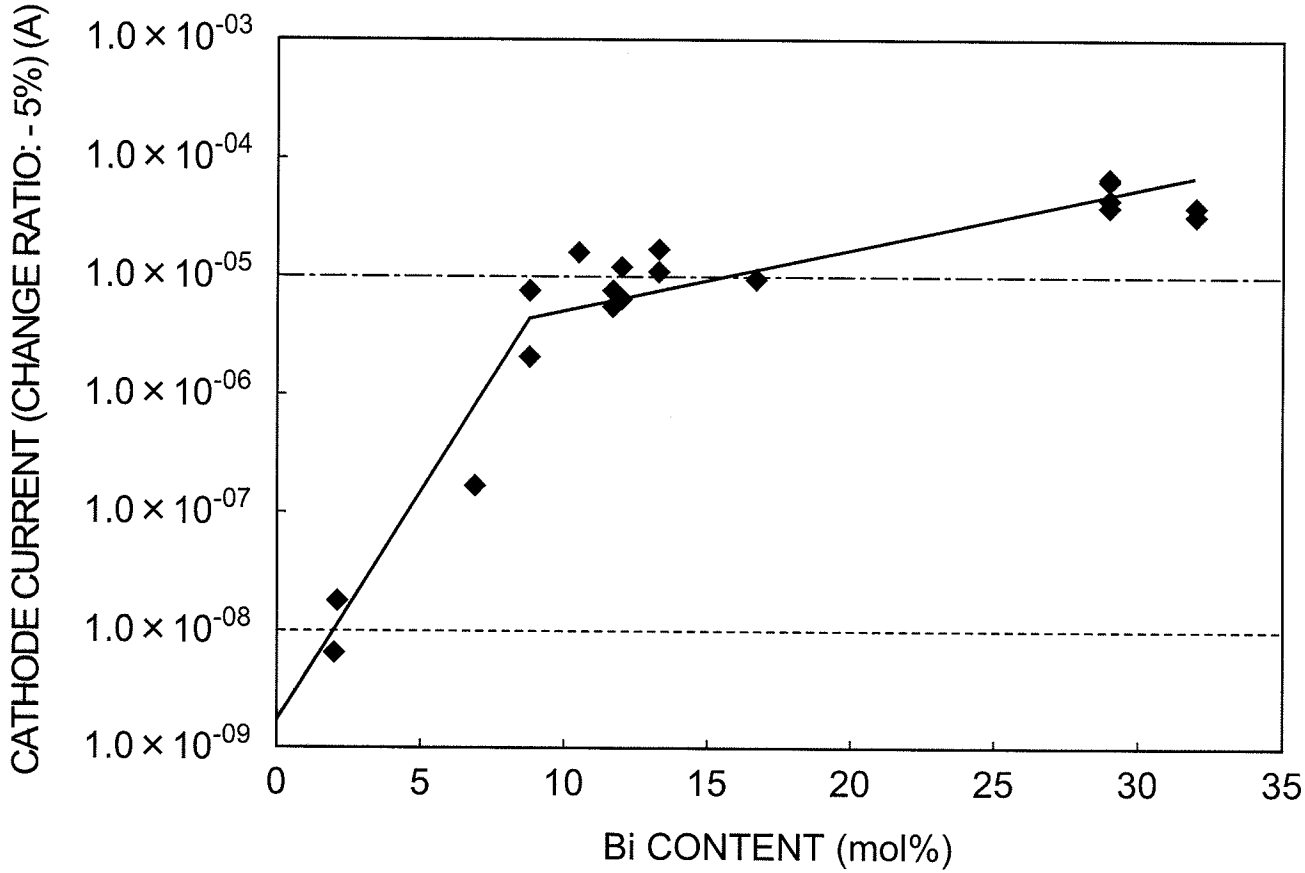
[FIG. 13] is a graph plotting the cathode current at a change ratio of −5% for each content illustrated in FIGS. 11 and 12.

FIGS. 11 and 12 illustrate the linearity of photocathode samples having the Bi contents of 2.0 to 32 mol %. FIGS. 11 and 12 are graphs illustrating the change ratios regarding to the cathode current in respective sets of photocathode samples with the Bi contents of 2.0 mol %, 2.1 mol %, 6.9 mol %, 8.8 mol %, 10.5 mol %, 11.7 mol %, 12 mol %, and 13.3 mol %; and 16.7 mol %, 29 mol %, and 32 mol %. The abscissa and ordinate of the graphs shown in FIGS. 11 and 12 represent the cathode current (A) and the change ratio (%), respectively. In a measurement system equipped with a mirror, a luminous flux from a light source having a predetermined color temperature is divided by a neutral density filter into a light quantity of 1:4, which is made incident on the photocathode of each sample as a reference light quantity, the resulting reference photocurrent value at 1:4 is defined as the change ratio of 0%, and the ratio of change in the photocurrent of 1:4 observed when increasing the light quantity of 1:4 is taken as the change ratio. FIG. 13 is a graph plotting the cathode current at a change ratio of −5% for each content illustrated in FIGS. 11 and 12. The abscissa and ordinate in FIG. 13 represent the Bi content (mol %) and the cathode current (A) at the change ratio of −5%, respectively. Since the upper limit for the linearity of the bi-alkali photocathodes (Sb—K—Cs) in accordance with Comparative Examples A1 and A2 has been known to be 0.01 μA, the position of $1.0\times10^{-8}$ A is indicated by a dotted line in FIG. 13. Since the upper limit for the linearity of the multi-alkali photocathode (Sb—Na—K—Cs) in accordance with Comparative Example B has been known to be 10 μA, the position of $1.0\times10^{-5}$ A is indicated by a dashed-single-dot line in FIG. 13.

As can be seen from FIG. 13, the samples having the Bi content of 8.8 mol % or higher exhibit a linearity on a par with the upper limit ($1.0\times10^{-5}$ A) for the linearity of the multi-alkali photocathode. While the photocathodes whose Bi content is lower than 8.8 mol % vary their linearity greatly as the Bi content changes, so as to reduce the linearity severely as the Bi content decreases, the linearity of the photocathodes having the Bi content of 8.8 mol % or greater varies less as the Bi content changes. Therefore, even when the Bi content is slightly changed by errors in manufacture, a high linearity can stably be secured without drastic fluctuations. In view of the foregoing, the photoelectron emission layer 18 containing 8.8 mol % or more of Bi relative to SbBi can stably yield a linearity substantially on a par with the upper limit for the linearity of the multi-alkali photocathode.

Figure 14:
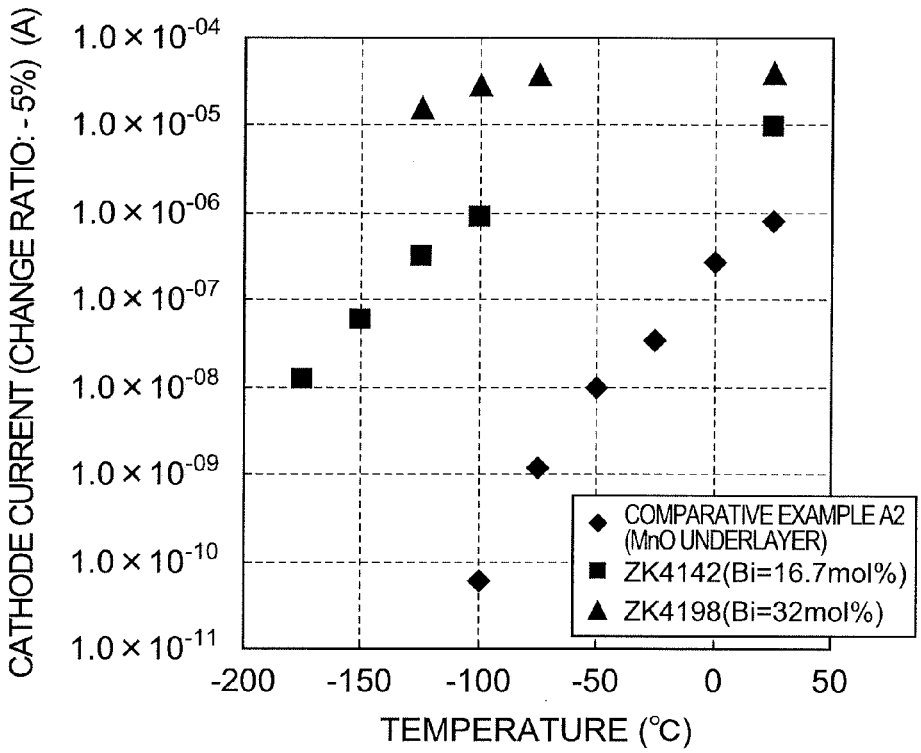
[FIG. 14] is a graph plotting the cathode current at the change ratio of −5% for each content at each temperature.

FIG. 14 is a graph plotting the cathode current at the change ratio of −5% for each content at each temperature, illustrating results of measuring the linearity in a low-temperature environment for photocathode samples having the Bi content of 32 mol % (ZK4198) and 16.7 mol % (ZK4142) in accordance with the examples and a conventional bi-alkali photocathode product sample (Comparative Example A2) employing manganese oxide as the underlayer in accordance with the comparative example. The abscissa and ordinate in FIG. 14 represent the temperature (° C.) in the measurement environment and the cathode current (A) at the change ratio of −5%, respectively.

As can be seen from FIG. 14, the conventional bi-alkali photocathode product sample (Comparative Example A2) employing manganese oxide as the underlayer drastically lowers the linearity as the temperature drops, so that the linearity at −100° C. decreases by $1\times10^4$ times or more from that of the linearity at room temperature (25° C.). In the sample having the Bi content of 16.7 mol % (ZK4142), on the other hand, the linearity at −100° C. only decreases to 0.1 times from that at room temperature (25° C.). In the sample having the Bi content of 32 mol % (ZK4198), the linearity at −100° C. hardly decreases from that at room temperature. It is therefore understood that the Bi content of 32 mol % or less can dramatically improve the linearity at low temperatures. Photocathodes which can thus improve the linearity at low temperatures are suitable for high-energy physicists to observe dark matters in the universe, for example. For this observation, a liquid argon scintillator (−189° C.) or liquid xenon scintillator (−112° C.) is used. In the conventional Comparative Example A2, as FIG. 14 illustrates, the cathode current flows by only $1.0\times10^{-11}$ (A) in the environment at −100° C., whereby no measurement is possible. ZK4142 (Bi=16.7 mol %) and ZK4198 (Bi=32 mol %) are preferably used for the liquid xenon scintillator and liquid argon scintillator, respectively.

Though a preferred embodiment has been explained in the foregoing, the present invention can be modified in various ways without being restricted to the above-mentioned embodiment. For example, in the photocathode 10, the substances contained in the substrate 12 and underlayer 16 are not limited to those mentioned above. The intermediate layer 14 may be omitted. Methods for forming the individual layers of the photocathode are not limited to those stated in the above-mentioned embodiment.

The photocathode in accordance with the embodiment may also be employed in electron tubes such as image intensifiers (II tube) other than photomultipliers. Combining an NaI scintillator with the photocathode can distinguish weak and strong X-rays from each other, thereby yielding images with a favorable contrast.

Using the photocathode in an embodiment of an image intensifier (high-speed shutter tube) can achieve a faster shutter having a high sensitivity without any special conductive underlayer (e.g., metallic Ni), since the photocathode exhibits a resistance lower than that of the conventional products.

Industrial Applicability

The present invention can provide a photocathode which can improve various characteristics.

The invention claimed is:

1. A photocathode comprising:

a photoelectron emission layer, adapted to emit a photoelectron to outside in response to light incident thereon, containing Sb and Bi;

a transmissive substrate formed on a light entrance side of the photoelectron emission layer; and an underlayer formed from MgO that is formed between the substrate and the photoelectron emission layer, on a light entrance side of the photoelectron emission layer, wherein the underlayer is formed on. the substrate or the underlayer is formed by the intermediary of an intermediate layer formed from $HfO_2$ on the substrate, the photoelectron emission layer is formed to be in direct contact with the underlayer, and the photoelectron emission layer contains 0.4 mol % or more and 16.7 mol % or less of Bi relative to the Sb and Bi.

2. A photocathode according to claim 1, wherein the photoelectron emission layer contains 0.4 mol % or more and 8.8 mol % or less of Bi relative to the Sb and Bi.

3. A photocathode according to claim 1, wherein the photoelectron emission layer contains 6.9 mol % or less of Bi relative to the Sb and Bi.

4. A photocathode according to claim 1, wherein the photoelectron emission layer contains 8.8 mol % or less of Bi relative to the Sb and Bi.

5. A photocathode according to claim 1, wherein the photoelectron emission layer is formed by causing a metallic potassium vapor and a metallic cesium vapor to react with a thin alloy film of SbBi.

6. A photocathode according to claim 1, wherein the photoelectron emission layer is formed by causing a metallic potassium vapor, a metallic rubidium vapor, and a metallic cesium vapor to react with a thin alloy film of SbBi.

7. A photocathode comprising:

a photoelectron emission layer, adapted to emit a photoelectron to outside in response to light incident thereon, containing Sb and Bi;

a transmissive substrate formed on a light entrance side of the photoelectron emission layer; and an underlayer formed from MgO that is formed between the substrate and the photoelectron emission layer, on a light entrance side of the photoelectron emission layer, wherein the underlayer is formed on the substrate or the underlayer is formed by the intermediary of an intermediate layer formed from $HfO_2$ on the substrate, the photoelectron emission layer is formed to be in direct contact with the underlayer, and the photoelectron emission layer contains 6,9 mol % or more and 32 mol % or less of Bi relative to the Sb and Bi.

8. A photocathode according to claim 7, wherein the photoelectron emission layer contains 8.8 mol % or more of Bi relative to the Sb and Bi.

9. A photocathode according to claim 7, wherein the photoelectron emission layer is formed by causing a metallic potassium vapor and a metallic cesium vapor to react with a thin alloy film of SbBi.

10. A photocathode according to claim 7, wherein the photoelectron emission layer is formed by causing a metallic potassium vapor, a metallic rubidium vapor, and a metallic cesium vapor to react with a thin alloy film of SbBi.

11. A light detection device comprising:

a photoelectron emission layer, adapted to emit a photoelectron to outside in response to light incident thereon, containing Sb and Bi;

a transmissive substrate formed on a light entrance side of the photoelectron emission layer; and an underlayer formed from MgO that is formed between the substrate and the photoelectron emission layer, on a light entrance side of the photoelectron emission layer, wherein the underlayer is formed on the substrate or the underlayer is formed by the intermediary of an intermediate layer formed from $HfO_2$ on the substrate, the photoelectron emission layer is formed to be in direct contact with the underlayer, and the photocathode is used in a light detection device using a liquid argon scintillator or liquid xenon scintillator.

12. A light detection device according to claim 11, wherein the photoelectron emission layer contains 32 mol % or less of Bi relative to the Sb and Bi,

13. A light detection device according to claim 11, wherein the photoelectron emission layer contains 29 mol % or less of Bi relative to the Sb and Bi.

14. A light detection device according to claim 11, wherein the photoelectron emission layer contains at least 16.7 mol % or less of Bi relative to the Sb and Bi.

15. A light detection device according to claim 11, wherein the photoelectron emission layer contains 6.9 mol % or less of Bi relative to the Sb and Bi.

16. A light detection device according to claim 11, wherein the photoelectron emission layer contains 0.4 mol % or more of Bi relative to the Sb and Bi.

17. A light detection device according to claim 11, wherein the photoelectron emission layer contains 8.8 mol % or more of Bi relative to the Sb and Bi.

18. A light detection device according to claim 12, having a linearity at −100° C. higher than a linearity of 0.1 times at 25° C.

19. A light detection device according to claim 13, exhibiting a quantum efficiency of 20% or higher at a peak in the wavelength range of 320 to 440 nm.

20. A light detection device according to claim 15, exhibiting a quantum efficiency of 35% or higher at a peak in the wavelength range of 300 to 430 nm.

21. A light detection device according to claim 11, comprising an intermediate layer formed from $HfO_2$ on the light entrance side of the photoelectron emission layer.

22. A light detection device according to claim 11, wherein the photoelectron emission layer is formed by causing a metallic potassium vapor and a metallic cesium vapor to react with a thin alloy film of SbBi.

23. A light detection device according to claim 11, wherein the photoelectron emission layer is formed by causing a metallic potassium vapor, a metallic rubidium vapor, and a metallic cesium vapor to react with a thin alloy film of SbBi.

* * * * *